United States Patent [19]

Schneerson

[11] 4,061,236

[45] Dec. 6, 1977

[54] APPARATUS FOR REMOVING DRINKING STRAWS FROM BOTTLES

[76] Inventor: Moshe Schneerson, 189a Assirey Zion St., Kiryat Sharet, Raanana, Israel

[21] Appl. No.: 685,795

[22] Filed: May 12, 1976

[51] Int. Cl.[2] ..... B65B 21/18

[52] U.S. Cl. ..... 214/309; 198/604; 214/301

[58] Field of Search ..... 198/604, 605; 214/309, 214/301

[56] References Cited

U.S. PATENT DOCUMENTS 3,570,693 3/1971 Peyton ..... 214/309

*Primary Examiner*—Robert J. Spar

*Assistant Examiner*—George F. Abraham

*Attorney, Agent, or Firm*—Silverman & Cass, Ltd.

[57] ABSTRACT

An apparatus is described for removing drinking straws from empty bottles having drinking straws projecting from their mouths, said apparatus comprising a pair of endless straw gripping belts adapted to move in substantially parallel relationship to each other adjacent to the path of said bottles maintained thereunder while the bottles are travelling on a moving bottle conveyor, and a plurality of pulleys for guiding portions of said straw gripping belts from a spaced relation to each other to a side by side substantially abutting relationship whereby the drinking straws are gripped and removed from the bottles and transported to another location, in which location the drinking straws are automatically removed from the gripping belts.

13 Claims, 5 Drawing Figures

APPARATUS FOR REMOVING DRINKING STRAWS FROM BOTTLES

The present invention concerns an apparatus for removing drinking straws from bottles.

When bottles are returned to the bottling plant they undergo a thorough cleaning and sterilizing process, which is effected entirely automatically. However, if drinking straws remain in the bottle they must be removed from the bottle manually, a process which is expensive in labour and time-consuming, when taking into consideration the tens of thousands of bottles that are handled by the plant during one day.

It is the object of the present invention to provide an automatic device for removing dranking straws from bottles.

The invention is based on the knowledge, that more than 90% of the drinking straws used for drinking are left in the bottle in a manner that they project therefrom.

The invention, therefore, consists in an apparatus for removing projecting drinking straws from empty bottles comprising:

a. a supporting frame structure,
b. a conveyor for the bottles either in a case or individually,
c. at least one pair of endless straw-gripping belts adapted for movement above said conveyor,
d. a plurality of spaced pairs of pulleys mounted at predetermined position on said frame structure for guiding said belts over a series of stretches as follows:
   i. a straw-gripping stretch in which said belts approach each other closely as they approach the top of the bottles whereby they clamp said projecting straw between them;
   ii. a stretch which extends upwards relative the bottle conveyor and in which said belts move together in close juxtaposition and remove said straws from said bottles;
   iii. a stretch in which the belts move closely together and hold said straw between them, and
   iv. a stretch in which said belts are separated to release said straws;
e. means to separate said belts in said last-mentioned stretch.

The invention is illustrated, by way of example only, in the accompanying drawing in which.

Figure 1:
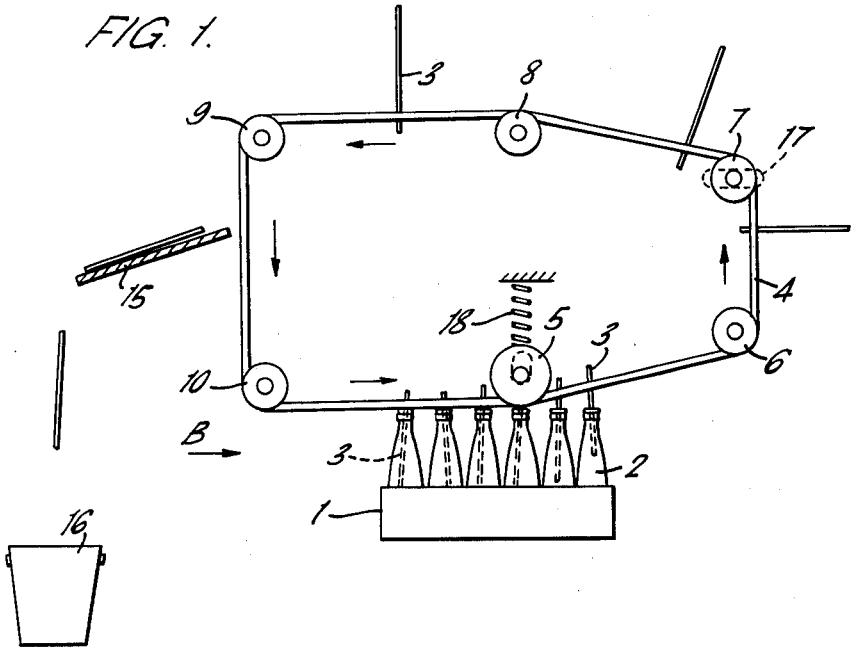
FIG. 1 is a schematic side elevation of one embodiment of the apparatus according to the invention.

Used bottles with or without straws are always returned to a plant for rebottling in transport cases having partitions so that the bottles are arranged within the case in longitudinal and transverse rows. Referring to FIG. 1, such a case 1 loaded with bottles 2 from which straws 3 project is fed to the apparatus according to the invention on a continuously moving conveyor (not shown), known per se.

It is to be understood from the outset that the apparatus here illustrated is destined for a case of bottles having four longitudinal rows of bottles and six transverse rows. However, the apparatus can be equally used for a single longitudinal row of bottles.

The apparatus comprises four pairs of endless belts 4 which travel over rows of pairs of pulleys 5, 6, 7, 8, 9 and 10. The stretch of belts between pulleys 10 and 5 constitutes the straw-gripping stretch, the stretch between pulleys 5 and 6 is the straw-removing stretch, that between pulleys 6 to 9 is the straw-holding stretch, while that between pulleys 9 and 10 is the straw-releasing stretch. Each row of pulleys 5–10 comprises four pairs of individual pulleys **11*a*, 11*b* which may be spacedly mounted on a shaft, or as shown, are formed on a roller 12 turnable on a shaft 13 on which said roller is mounted by means of bearings 14. The pulleys 11*a*, 11*b* of pulley rows 5–9 are in close proximity to each other while the pulleys 11*a* and 11*b* of pulley row 10 are spaced from each other. Thus, the belts 4 run closely together in their stretches between pulley rows 5–9, while the belts are separated in their stretches between pulley rows 9 and 10, and 10 and 5. As the belts travel above the row of bottles 2 in very close proximity to their top, the belts will clamp the straws 2 between them, as they approach pulley 5. As has been mentioned above, the straws are held between the belts while they travel over pulley rows 6, 7, 8 and 9 and will be released during the stretch between pulley rows 9 and 10 near a ramp or the like 15, to fall thereon and into a receptacle indicated by 16. A belt tensioning mechanism indicated schematically by 17 is associated with pulley 7**.

If often happens that a crown cork or other refuse is located in a case 1 before the bottles are inserted and therefore a bottle may assume a higher position than the others within the same case 1. This is compensated for by the self-adjusting mechanism associated with pulley row 5. The mechanism comprises an elastic mounting of the shaft of pulleys 5 on springs 18, so that said pulleys may be raised slightly toward the side on which the higher bottle exerts pressure, so that the belts on said side are raised correspondingly.

Figure 4:
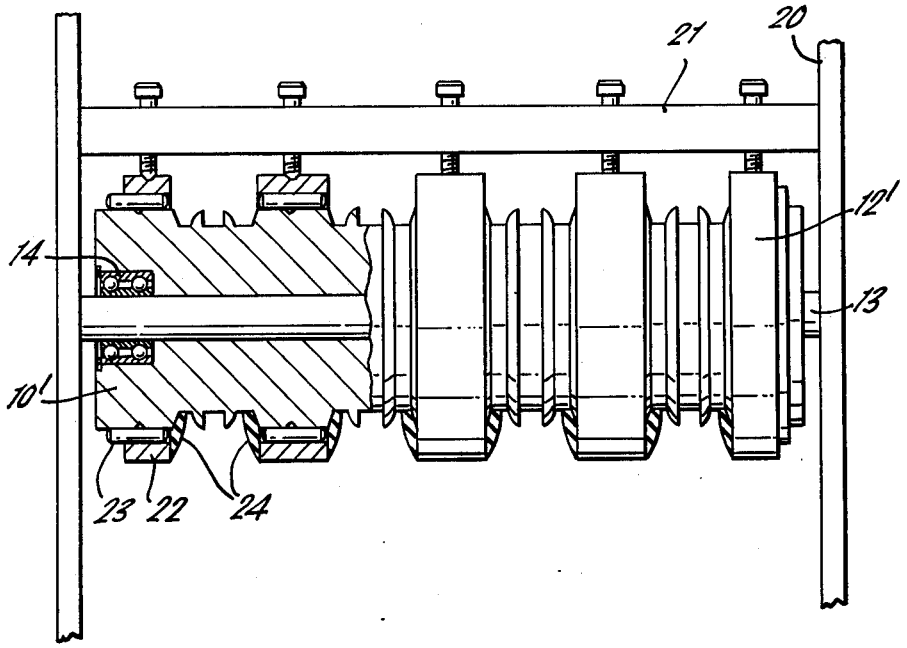
FIG. 4 is an elevational view partly in section on a larger scale of a detail.
Figure 2:
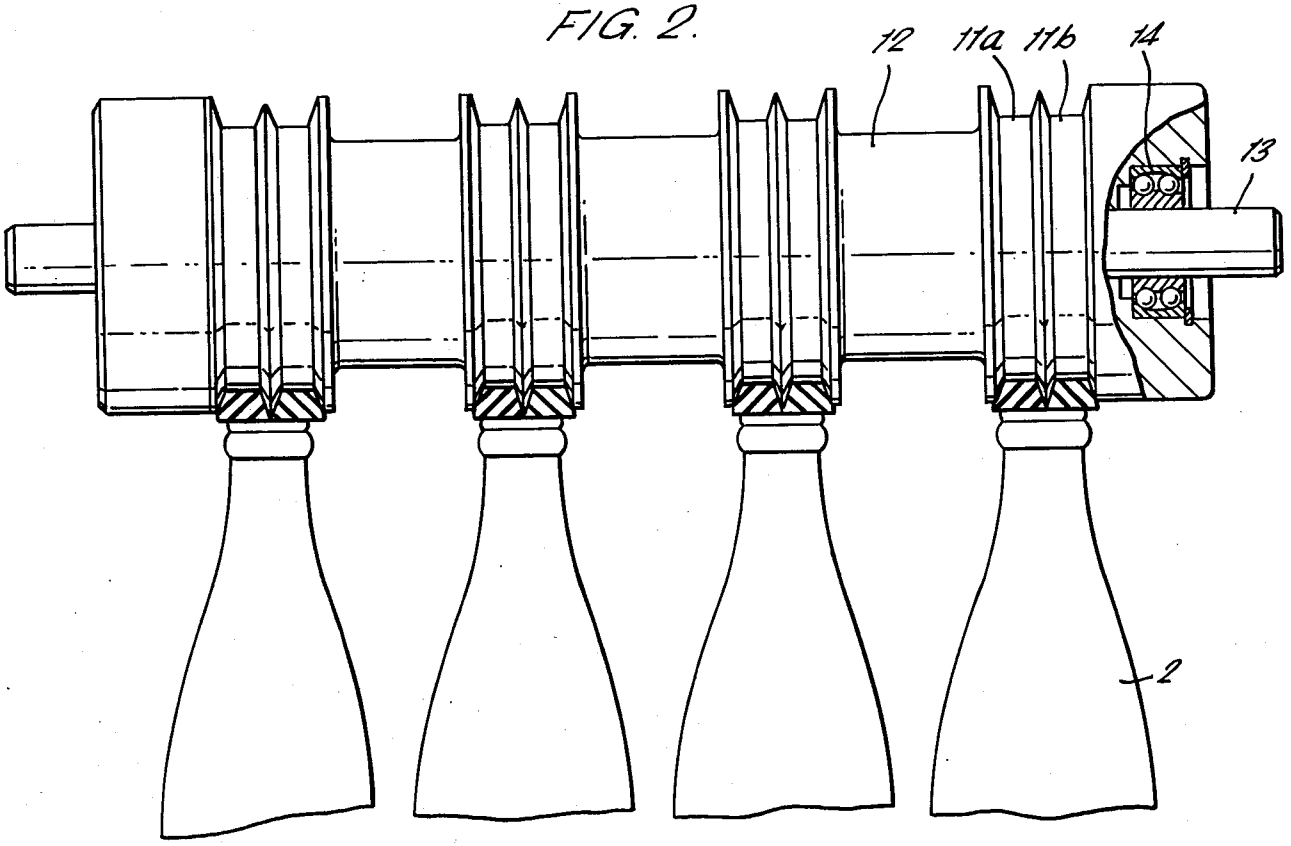
FIG. 2 is an end view on an enlarged scale of a part of said apparatus.
Figure 3:
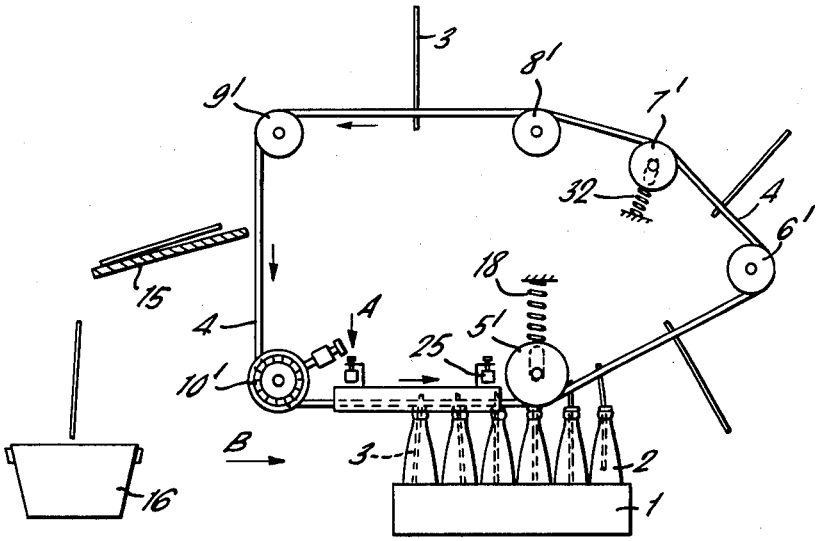
FIG. 3 is a schematic side elevation of a second embodiment of the apparatus according to the invention.
Figure 5:
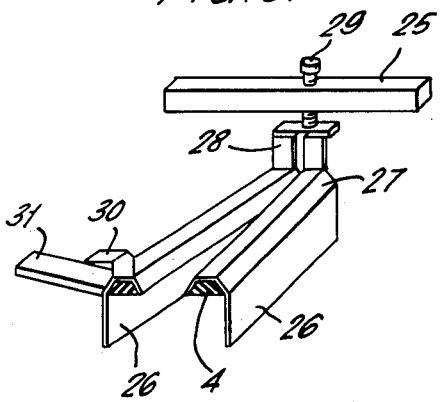
FIG. 5 is a perspective view of another detail.

In the apparatus illustrated in FIGS. 3–5, the straw-gripping stretch of the pairs of endless belts 4 is that between pulleys 10' and 5', the straw-removing stretch between pulleys 5' and 6', the straw-holding stretch between pulleys 6' and 9' and the straw-releasing stretch between pulleys 9' and 10'.

According to this embodiment the spaced pulleys 10' which are mounted on shaft 13 by means of bearings 14 are fixedly mounted with respect to the frame 20 of the apparatus on a bar 21, which extends between the sides of the frame. This bar supports bearing housings 22 for outer bearings 23 which surround the pulleys 10' so that the latter can rotate freely but are fixed in axial direction. On the housings 22, in the space between adjacent pulleys 10' guides 24 are provided so that when the bottles in a case approach said pulleys, the neck of the bottles is centered between them.

Behind pulleys 10', i.e. in the stretch between it and pulleys 5, a device for centering the projecting straws within the already centered bottles is provided in that between the sides of the frame 20 of the apparatus a bar 25 is fixedly mounted. This bar holds pairs of two sheet metal guides for the pairs of belts 4. Said guides each comprise a vertical part 26 (FIG. 5) and bent over portion 27 under which the belts 4 travel. The vertical parts 26 of the guides are spaced from each other substantially by the width of the neck of a bottle, while the portions 27 approach each other so that near pulleys 5' they are separated from each other substantially only by the diameter of a straw or less than that. An elbow bracket 28 bent off from the end of the guides closest to pulleys 5' supports the guide on bars 25 by means of bolts 29 while the ends of the guides closest to pulley 10' are integral with a bracket 30 which is supported on bars 31 mounted to the frame of the apparatus.

The stretch between pulleys 5' and 6' should be at a certain angle which is a function of the speed of the conveyor transporting the bottle case and the height of the bottles. This angle can be expressed as follows: tan $\alpha = (H/L)$ wherein $\alpha$ is the angle between the horizontal and the stretch between pulleys 5' and 6' while l is the length of a case of bottles and h is the height of the bottle.

The relative speeds can be expressed as follows:

$$V_2 = V_1 \cos \alpha$$

wherein $V_1$ is equal to the speed of the belts and $V_2$ to the speed of the case of bottles as it travels on the conveyor (not shown).

In order to tension the belts properly, pulleys 7' are tensioned by means of springs 32 fixed to the framework of the apparatus.

I claim:

1. An apparatus for removing projecting drinking straws from empty bottles comprising:

a. a supporting frame structure, b. a conveyor for the bottles either in a case or individually, c. at least one pair of endless straw-gripping belts adapted for movement above said conveyor, d. a plurality of spaced pairs of pulleys mounted at predetermined position on said frame structure for guiding said belts over a series of stretches as follows:

i. a straw-gripping stretch which extends generally parallel relative the bottle conveyor and in which said belts approach each other closely as they approach the top of the bottles whereby the belts clamp said projecting straws between them;

ii. a straw-removing stretch which extends generally upwardly relative the bottle conveyor and in which said belts move together in close juxtaposition and remove said straws from said bottles;

iii. a straw-holding stretch which extends generally normal to and then substantially parallel to the bottle conveyor and in which the belts are close together and hold said straws between them, and iv. a straw-ejecting stretch which extends generally normal relative the bottle conveyor and in which said belts are separated to release said straws;

e. means to separate said belts in said last-mentioned stretch, said last-mentioned stretch joining at its end with the beginning of the first-mentioned stretch.

2. An apparatus as claimed in claim 1 wherein said means are two pulleys spaced from each other.

3. An apparatus as claimed in claim 1 wherein the pairs of pulleys are individually mounted on a shaft mounted on said supporting structure generally normal to the direction of movement of the said bottle conveyor.

4. An apparatus as claimed in claim 1 wherein the pairs of pulleys are formed on a roller mounted on a shaft.

5. An apparatus as claimed in claim 1 wherein a plurality of groups of pairs of belts are provided to remove the straws from a plurality of bottles conveyed in a transverse row below said belts.

6. An apparatus as claimed in claim 1 wherein the pair of pulleys located at the end of said straw-gripping stretch are elastically mounted on said frame structure.

7. An apparatus as claimed in claim 1 including means for centering the bottles between said belts on said conveyor.

8. An apparatus as claimed in claim 1 including means for centering the straws between said belts in said straw-gripping stretch.

9. An apparatus as claimed in claim 7 wherein said means for centering the bottles comprise mountings for the pulleys at the beginning of said straw-gripping stretch in external bearings which are fixed with respect to the frame structure, and guide means provided on said bearings between the pairs of pulleys.

10. An apparatus as claimed in claim 8 wherein the means for centering the straws between the belts comprise pairs of sheet metal guides fixed to the said frame structure and having vertical parts which are spaced from each other by substantially the width of a bottle neck and bent-over portions under which the said belts run and which approach each other in the direction of travel of the belts to be in close juxtaposition at the end of said stretch.

11. An apparatus as claimed in claim 1 including spring-tensioned means provided for the mounting of one of the series of pairs of pulleys.

12. An apparatus as claimed in claim 1 wherein the belts in said straw-removing stretch are disposed an angle $\alpha$ with the horizontal as follows:

$$\tan \alpha = (h/l)$$

wherein $h$ is the height of the bottles and $l$ is the length of a case of bottles.

13. An apparatus as claimed in claim 12 wherein the relative speeds of said bottle conveyor and said pairs of belts is expressed as follows:

$$V_2 = V_1 \cos \alpha$$

wherein $V_1$ is the speed of the belts and $V_2$ is the speed of the conveyor.

* * * * *